US012721424B2

(12) United States Patent
Yang et al.

(10) Patent No.: US 12,721,424 B2
(45) Date of Patent: Sep. 1, 2026

(54) SPLIT APPLICATOR AND PACKAGING CONTAINER INCLUDING SAME

(71) Applicant: SHYA HSIN PACKAGING INDUSTRY (CHINA) CO., LTD., Kunshan (CN)

(72) Inventors: Cuihong Yang, Kunshan (CN); Changmai Zhang, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 154 days.

(21) Appl. No.: 18/806,712

(22) Filed: Aug. 16, 2024

(65) Prior Publication Data

US 2025/0331631 A1 Oct. 30, 2025

(30) Foreign Application Priority Data

Apr. 30, 2024 (CN) ..... 202410544346.1

(51) Int. Cl.
*A45D 40/26* (2006.01)
*A46B 9/00* (2006.01)
*A46D 3/00* (2006.01)

(52) U.S. Cl.
CPC ..... *A46B 9/005* (2013.01); *A45D 40/265* (2013.01); *A46D 3/00* (2013.01); *A46B 2200/1046* (2013.01)

(58) Field of Classification Search
CPC .. A45D 34/041; A45D 34/045; A45D 34/046; A45D 40/261; A45D 40/265; A45D 40/267; A45D 2200/10; A45D 2200/1009
See application file for complete search history.

(56) References Cited

U.S. PATENT DOCUMENTS 11,219,292 B2 * 1/2022 Bianco ..... A45D 34/041
2006/0051153 A1 3/2006 Delage
2009/0095317 A1 4/2009 Poetschl et al.
(Continued)

FOREIGN PATENT DOCUMENTS

CN 113365530 A 9/2021
CN 116391956 A 7/2023
(Continued)

*Primary Examiner* — Rachel R Steitz
(74) *Attorney, Agent, or Firm* — Bayramoglu Law Offices LLC

(57) ABSTRACT

The provided are a split applicator and a packaging container including same. The split applicator includes a first application head and a second application head; an accommodation cavity is formed in the first application head; the first application head includes a first mounting portion and a first application portion that are fixedly connected; the second application head includes a second mounting portion and a second application portion that are fixedly connected; the second application head is provided in the accommodation cavity; the first mounting portion is fixedly connected to the second mounting portion; and a hardness of the first application head is less than a hardness of the second application head. According to the split applicator, the second application head is provided in the first application head. When the first application portion is used for makeup, the second application head can support the first application head.

13 Claims, 9 Drawing Sheets

(56) References Cited

U.S. PATENT DOCUMENTS

| | | | | |
|---|---|---|---|---|
| 2018/0279740 | A1* | 10/2018 | Kukreja | A45D 34/045 |
| 2020/0329846 | A1* | 10/2020 | Bianco | A45D 40/267 |
| 2024/0306796 | A1* | 9/2024 | Vanoncini | A45D 40/26 |
| 2025/0082088 | A1* | 3/2025 | Srivastava | A45D 40/26 |

FOREIGN PATENT DOCUMENTS

| | | | |
|---|---|---|---|
| CN | 117084495 | A | 11/2023 |
| CN | 220174670 | U | 12/2023 |
| CN | 220174671 | U | 12/2023 |
| CN | 222548747 | U | 3/2025 |

* cited by examiner

SPLIT APPLICATOR AND PACKAGING CONTAINER INCLUDING SAME

CROSS-REFERENCE TO THE RELATED APPLICATIONS

This application is based upon and claims priority to Chinese Patent Application No. 202410544346.1, filed on Apr. 30, 2024, the entire contents of which are incorporated herein by reference.

TECHNICAL FIELD

The present disclosure relates to makeup tool technology, and in particular to a split applicator and a packaging container including same.

BACKGROUND

For existing cosmetic brushes such as an eyelash brush, an eyebrow brush, and a lip gloss pen, the brush head is integrally manufactured from a plastic material. The surface of the brush head is flocked, thus forming a cotton head. The cotton head is used to dip a cosmetic material for makeup. However, the existing cotton head has non-uniform application due to the soft material, so as to affect a makeup effect.

SUMMARY

The present disclosure provides a split applicator, to overcome the above defects. According to the split applicator, the second application head is provided in the first application head. When the first application portion is used for makeup, the second application head can support the first application head, thereby improving the makeup effect.

To solve the technical problems, the present disclosure employs the following technical solutions:

The present disclosure provides a split applicator, including a first application head and a second application head; an accommodation cavity is formed in the first application head; the first application head includes a first mounting portion and a first application portion that are fixedly connected; the second application head includes a second mounting portion and a second application portion that are fixedly connected; the second application head is provided in the accommodation cavity; the first mounting portion is fixedly connected to the second mounting portion; and a hardness of the first application head is less than a hardness of the second application head.

Optionally, a first end of the first mounting portion is connected to a first end of the first application portion; a second end of the first mounting portion and a second end of the first application portion each are a free end; and the accommodation cavity extends from the second end of the first application portion to the first mounting portion along an axial direction of the first application head.

Optionally, the accommodation cavity is a blind groove or a through groove.

Optionally, the first mounting portion and the second mounting portion are fixedly connected by clamping, gluing or welding.

Optionally, a clamping groove is formed in the first mounting portion; the clamping groove communicates with the accommodation cavity; a fastener is provided on the second mounting portion; and the fastener is clamped into the clamping groove, such that the first mounting portion and the second mounting portion are clamped and fixed.

Optionally, the clamping groove is a through groove or a blind groove; the fastener is elastic; and the fastener protrudes outward along a radial direction of the second mounting portion.

Optionally, the second application portion includes a first end fixedly connected to the second mounting portion, and a second end being a free end; a bump is fixedly provided at the second end of the second application portion; a groove is formed at the second end of the first application portion; the groove communicates with the accommodation cavity; and the bump is provided in the groove.

Optionally, an outer peripheral wall of the first application portion forms a first application surface; a second application surface is provided at the second end of the first application portion; a third application surface is provided at the second end of the second application portion; the second application surface and the third application surface each are an oblique surface, and the second application surface and the third application surface are coplanar; and alternatively, the second application surface and the third application surface each are a curved surface, and the second application surface and the third application surface are spliced into a smooth concave surface or a smooth convex surface.

Optionally, a material of the first application head includes a first plastic material; a material of the second application head includes a second plastic material; a hardness of the first plastic material is less than a hardness of the second plastic material; and a flocked layer is provided on each of the first application surface, the second application surface and the third application surface.

Optionally, a material of the first application head includes a plastic material; a material of the second application head includes a temperature-sensitive material; the temperature-sensitive material includes metal, metal alloy, ceramic, glass or stone; the first application surface and the second application surface each are provided with a flocked layer, and the third application surface is a smooth surface; and alternatively, the first application surface, the second application surface and the third application surface each are provided with the flocked layer.

The present disclosure further provides a packaging container, including the split applicator, and further including a sleeve assembly, where the sleeve assembly includes an outer lid and a bottle body; a brush rod is fixedly provided in the outer lid; the applicator is fixedly provided on the brush rod; an inner stopper is fixedly provided at a neck of the bottle body; and the outer lid covers the bottle body detachably.

The present disclosure has the following beneficial effects: According to the present disclosure, the applicator includes the first application head and the second application head. The second application head is provided in the first application head. The hardness of the second application head is greater than the hardness of the first application head. When the first application portion is used for makeup, the second application head can support the first application head, thereby improving the makeup effect. The hardness of the first application surface is different from the hardness of the third application surface, which can meet different makeup requirements of the user, and expand use functions of the applicator. The first mounting portion and the second mounting portion are fixedly provided together with a high bonding strength, which effectively prevents the second application head from falling off from the first application head. Since the first application head is made of an elastic material, the first application head can cause elastic deformations when the second application head is mounted, thereby facilitating mounting of the second application head.

Figure 1:
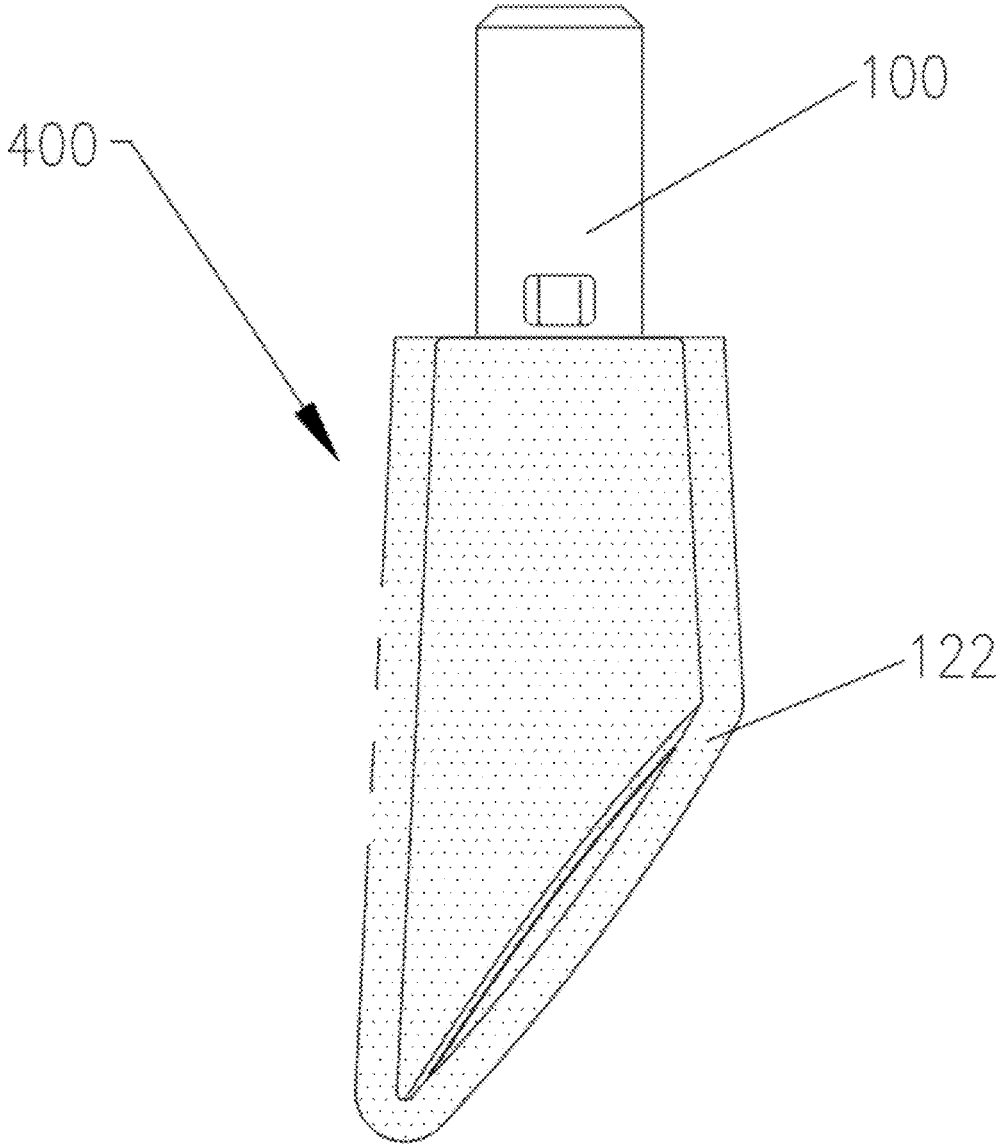
FIG. 1 is a first schematic structural view of an applicator according to Embodiment 1 of the present disclosure.
Figure 2:
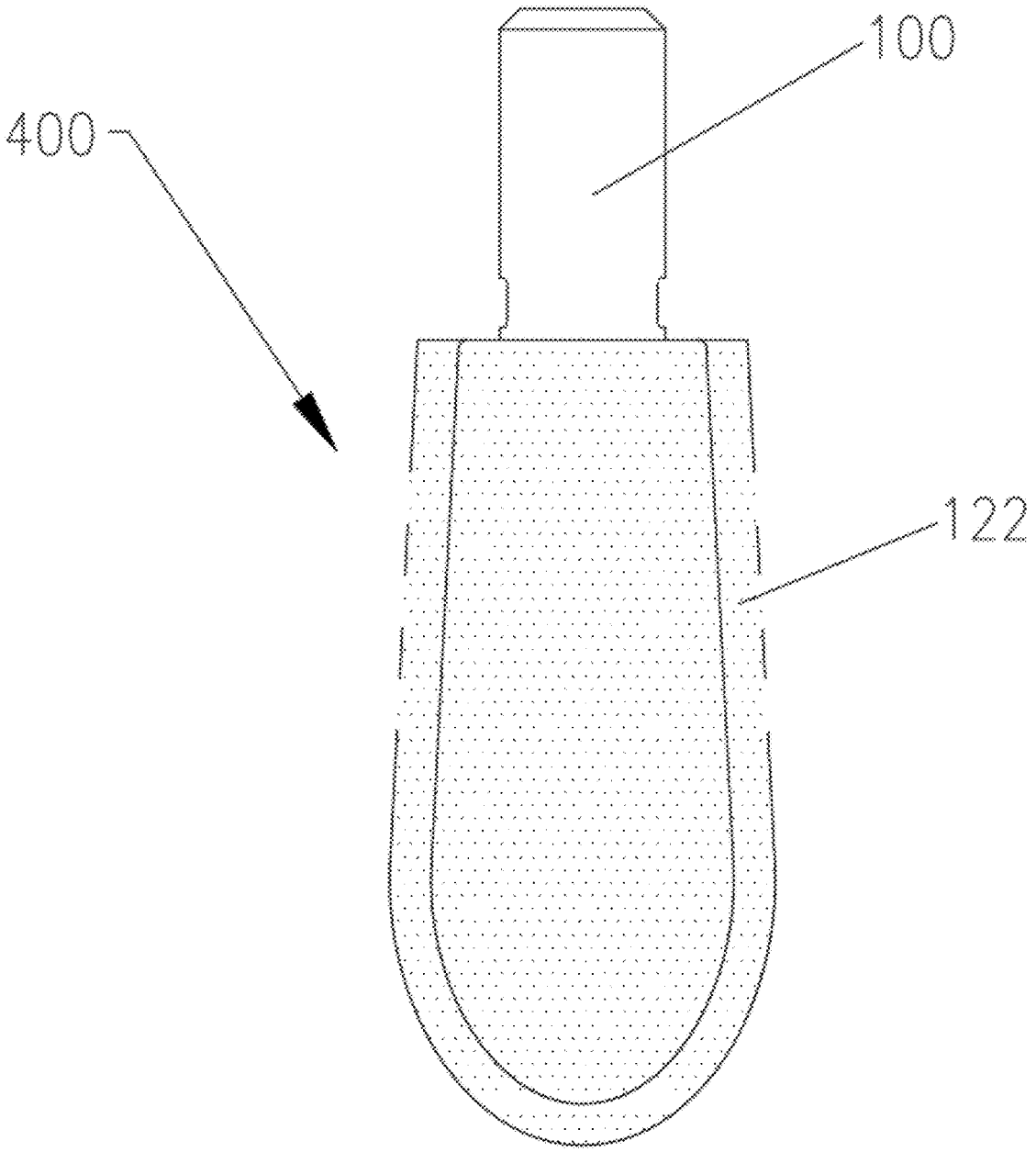
FIG. 2 is a second schematic structural view of an applicator according to Embodiment 1 of the present disclosure.

In the figures: 100—first application head, 101—accommodation cavity, 110—first mounting portion, 111—clamping groove, 120—first application portion, 121—first application surface, 122—flocked layer, 123—groove, 124—second application surface, 200—second application head, 210—second mounting portion, 211—fastener, 220—second application portion, 221—third application surface, 222—bump, 300—sleeve assembly, 310—outer lid, 311—brush rod, 320—bottle body, 321—inner stopper, and 400—applicator.

DETAILED DESCRIPTION OF THE EMBODIMENTS

The following describes the technical solutions in the embodiments of the present disclosure clearly and completely with reference to the embodiments of the present disclosure. Apparently, the embodiments described are merely some rather than all of the embodiments of the present disclosure. All other embodiments obtained by a person of ordinary skill in the art based on the embodiments of the present disclosure without creative efforts shall fall within the protection scope of the present disclosure.

It should be noted that the terms "first", "second" and so on in the description and claims of the present disclosure and in the above accompanying drawings are intended to distinguish similar objects but do not necessarily indicate a specific order or sequence. It should be understood that the objects used in such a way may be exchanged under proper conditions to make it possible to implement the described implementations of this application in sequences except those illustrated or described herein. Moreover, the terms "include", "have" and their variants mean to cover a non-exclusive inclusion. For example, a process, method, system, product or device that includes a list of steps or units is not necessarily limited to those steps or units which are clearly listed. Instead, they may include other steps or units which are not expressly listed or inherent to such a process, method, product, or device.

For ease of description, spatially relative terms, such as "above", "on the upper side of", "on the upper surface of" and "on", can be used to describe the spatial positional relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

Embodiment 1: As shown in FIGS. 1-8, a split applicator includes first application head 100 and second application head 200. Accommodation cavity 101 is formed in the first application head 100. The first application head 100 includes first mounting portion 110 and first application portion 120 that are fixedly connected. The second application head 200 includes second mounting portion 210 and second application portion 220 that are fixedly connected. The second application head 200 is provided in the accommodation cavity 101. The first mounting portion 110 is fixedly connected to the second mounting portion 210. A hardness of the first application head 100 is less than a hardness of the second application head 200.

The applicator 400 includes the first application head 100 and the second application head 200 that are formed independently. Optionally, the first application head 100 is made of an elastoplastic. The first application head 100 is internally hollowed out to form the accommodation cavity 101. The second application head 200 is provided in the accommodation cavity 101. The first application head 100 and the second application head 200 are fixedly provided together through the first mounting portion 110 and the second mounting portion 210. The first application portion 120 and the second application portion 220 are used for makeup.

In the present disclosure, the second application head 200 is provided in the first application head 100. The hardness of the second application head 200 is greater than the hardness of the first application head 100. When the first application portion 120 is used for makeup, the second application head 200 is used to support the first application head 100, thereby improving the makeup effect. The hardness of the first application portion 120 is different from the hardness of the second application portion 220, which can meet different makeup requirements of the user, and expand use functions of the applicator. The first mounting portion 110 and the second mounting portion 210 are fixedly provided together with a high bonding strength, which effectively prevents the second application head 200 from falling off from the first application head 100. Since the first application head 100 is made of an elastic material, the first application head 100 can cause elastic deformations when the second application head 200 is mounted, thereby facilitating mounting and fixation of the second application head 200.

Figure 3:
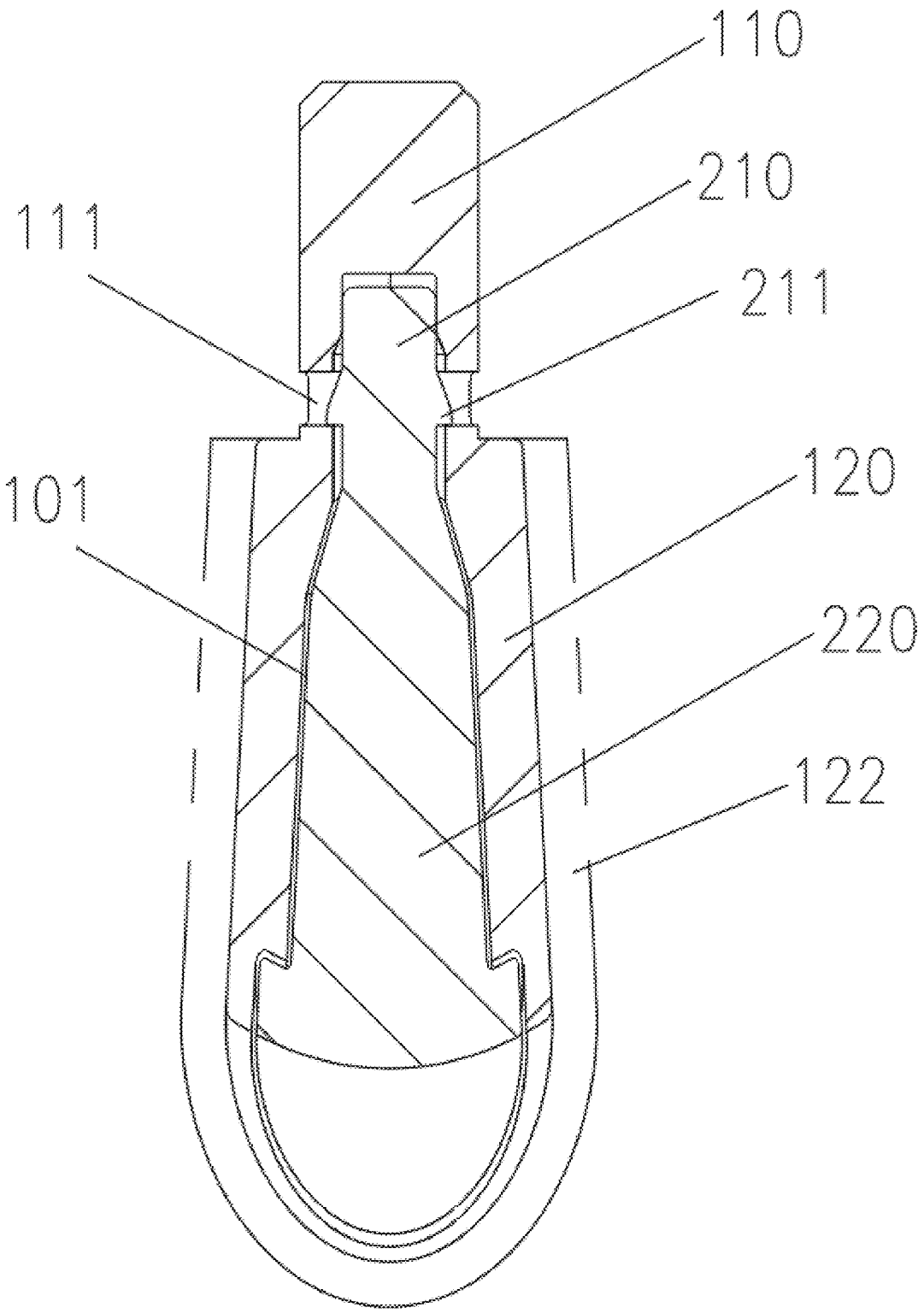
FIG. 3 is a third schematic structural view of an applicator according to Embodiment 1 of the present disclosure.
Figure 4:
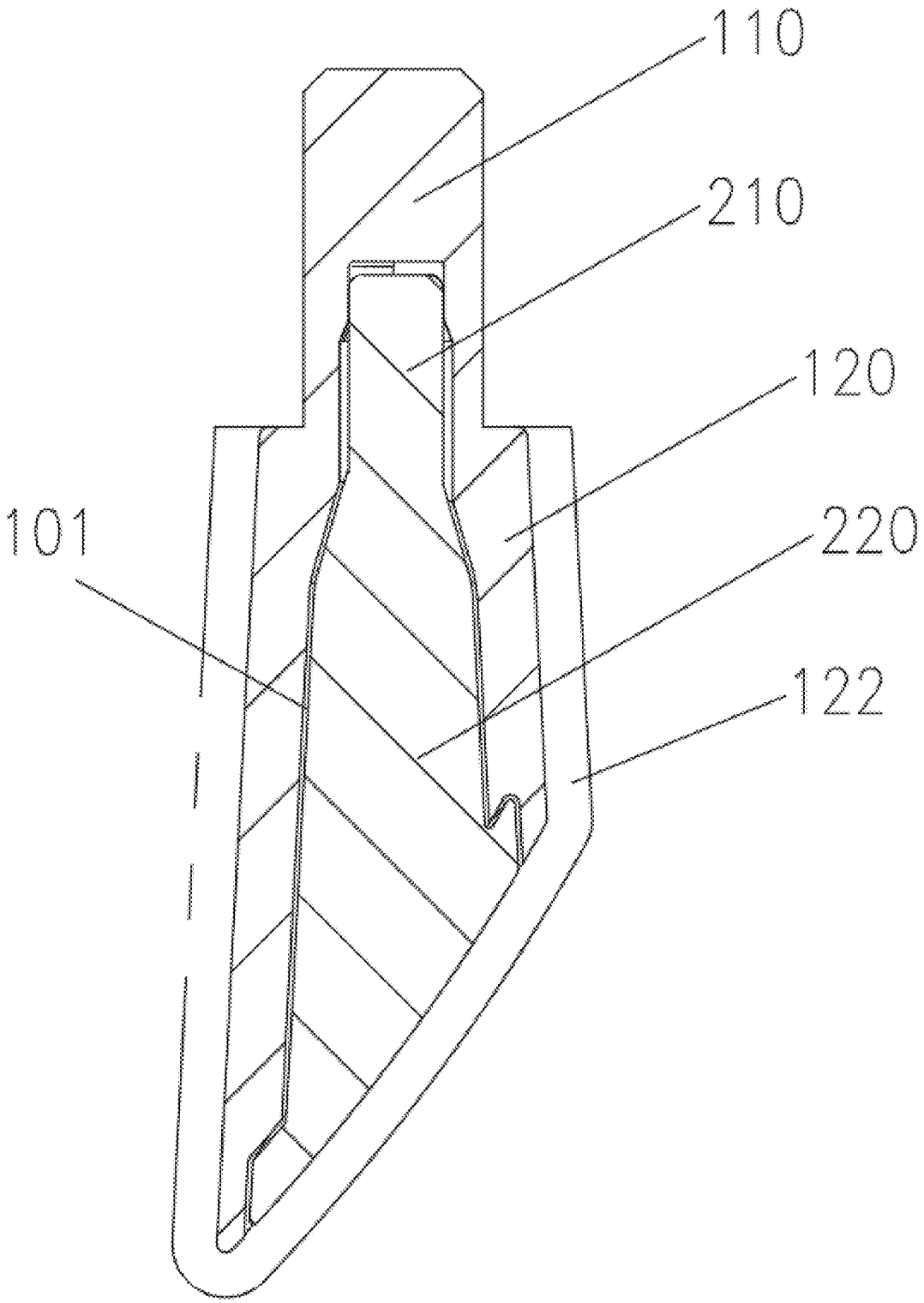
FIG. 4 is a fourth schematic structural view of an applicator according to Embodiment 1 of the present disclosure.
Figure 5:
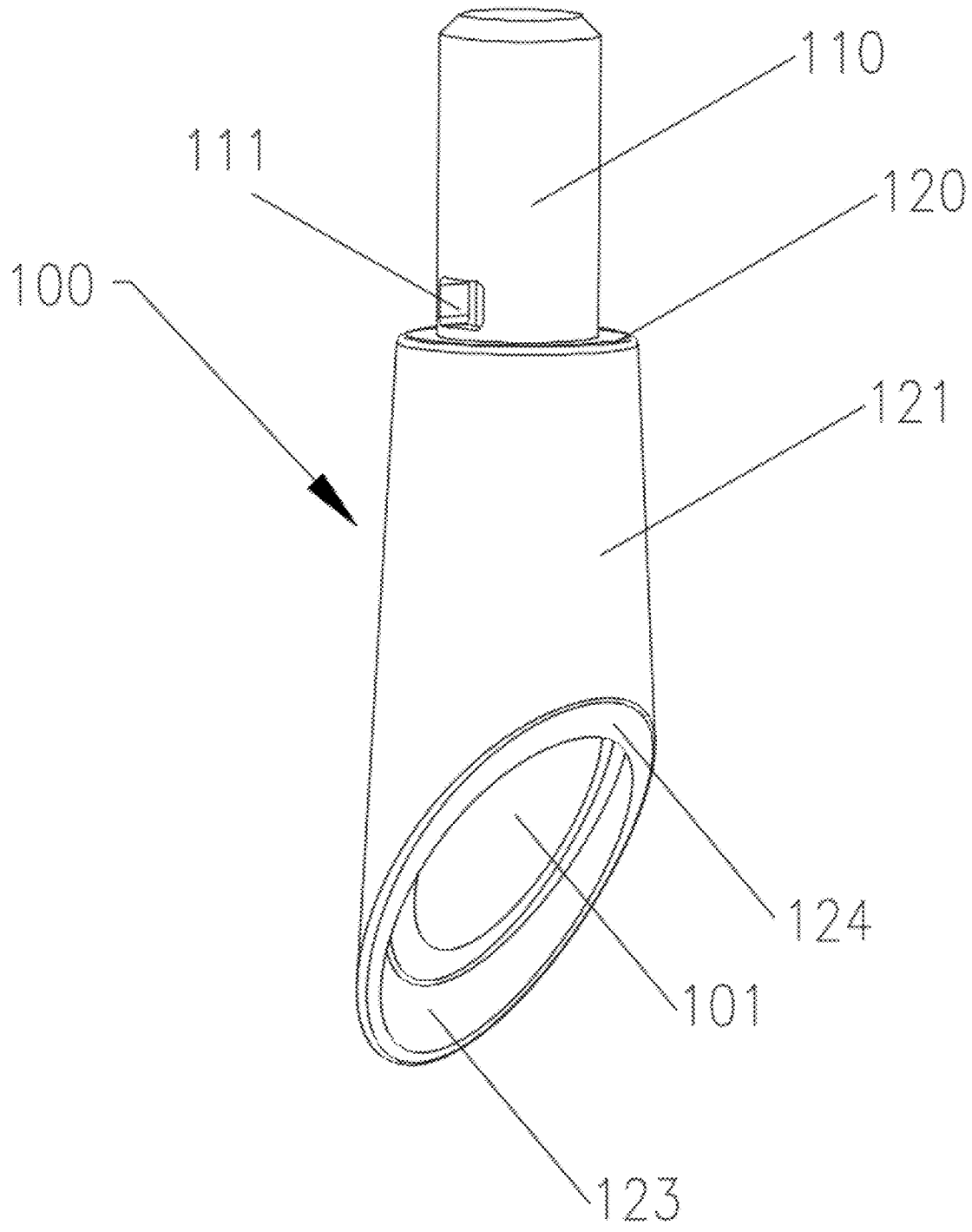
FIG. 5 is a first schematic structural view of a first application head according to Embodiment 1 of the present disclosure.

As shown in FIGS. 3-5, a first end of the first mounting portion 110 is connected to a first end of the first application portion 120. A second end of the first mounting portion 110 and a second end of the first application portion 120 each are a free end. The accommodation cavity 101 extends from the second end of the first application portion 120 to the first mounting portion 110 along an axial direction of the first application head 100. That is, the accommodation cavity 101 is axially formed in the first application head 100.

In a possible implementation, as shown in FIGS. 3-4, the accommodation cavity 101 is a blind groove. The accommodation cavity 101 forms an open end at the second end of the first application portion 120. The accommodation cavity 101 forms a sealed end in the first mounting portion 110. In another possible implementation, the accommodation cavity 101 is a through groove. That is, the accommodation cavity 101 extends to the second end of the second mounting portion 210 from the second end of the first application portion 120 all the time. The accommodation cavity 101 forms an open end at the second end of the first application portion 120 and the second end of the second mounting portion 210. When the accommodation cavity 101 is the through groove, the applicator is machined and formed conveniently.

Optionally, the first mounting portion 110 and the second mounting portion 210 are fixedly connected by clamping, gluing or welding. The second mounting portion 210 and the first mounting portion 110 are fixed in the accommodation cavity 101 by clamping of a fastener and a clamping groove, gluing or ultrasonic welding, with a high bonding strength.

As shown in FIGS. 3-7, clamping groove 111 is formed in the first mounting portion 110. The clamping groove 111 communicates with the accommodation cavity 101. Fastener 211 is provided on the second mounting portion 210. The fastener 211 is clamped into the clamping groove 111, such that the first mounting portion 110 and the second mounting portion 210 are clamped and fixed.

As shown in FIG. 3, the clamping groove 111 is a through groove, and the fastener 211 is clamped into the through groove. By designing the clamping groove 111 as the through groove, the first mounting portion 110 is machined conveniently, which simplifies a structure of a mold, and improves the bonding strength between the first application head 100 and the second application head 200. Alternatively, the clamping groove 111 may also be a blind groove, and the fastener 211 is clamped into the blind groove, which can also achieve the purpose of the second application head 200. The fastener 211 is elastic. The fastener 211 protrudes outward along a radial direction of the second mounting portion 210. The fastener 211 includes a first end away from the second application portion 220, and a second end close to the second application portion 220. In a possible implementation, except that the first end of the fastener 211 is fixedly connected to the second mounting portion 210, a remaining portion of the fastener 211 is disconnected from the second mounting portion 210. The fastener 211 is obliquely connected to the second mounting portion 210. When the second application head 200 is placed into the accommodation cavity 101 of the first application head 100, the fastener 211 is squeezed to get close to the second mounting portion 210. Upon completion of assembly, the fastener 211 is ejected out and clamped into the clamping groove 111, so as to fix the second application head 200 in the first application head 100, thereby effectively preventing the second application head 200 from falling off.

Figure 7:
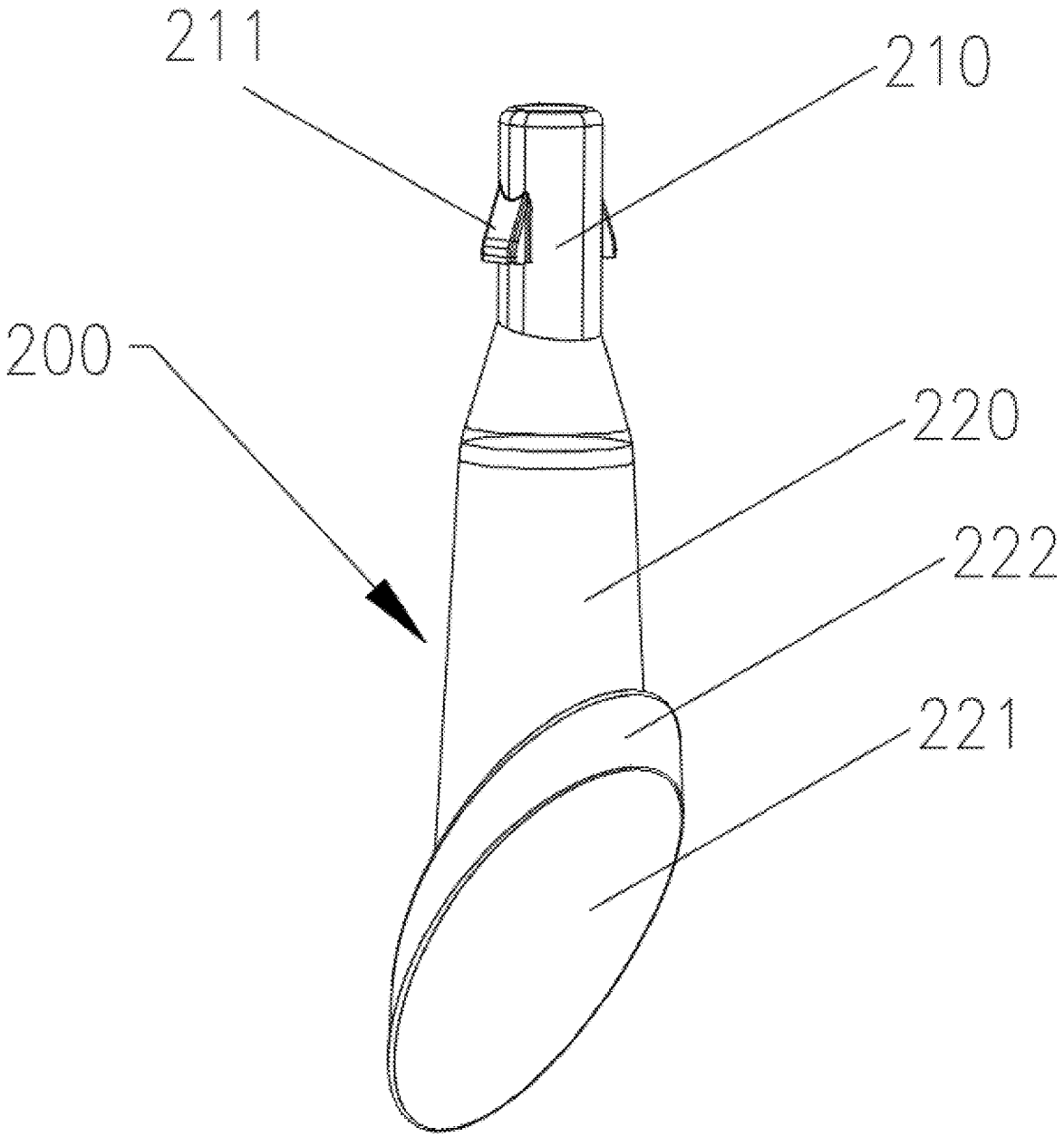
FIG. 7 is a first schematic structural view of a second application head according to Embodiment 1 of the present disclosure.
Figure 8:
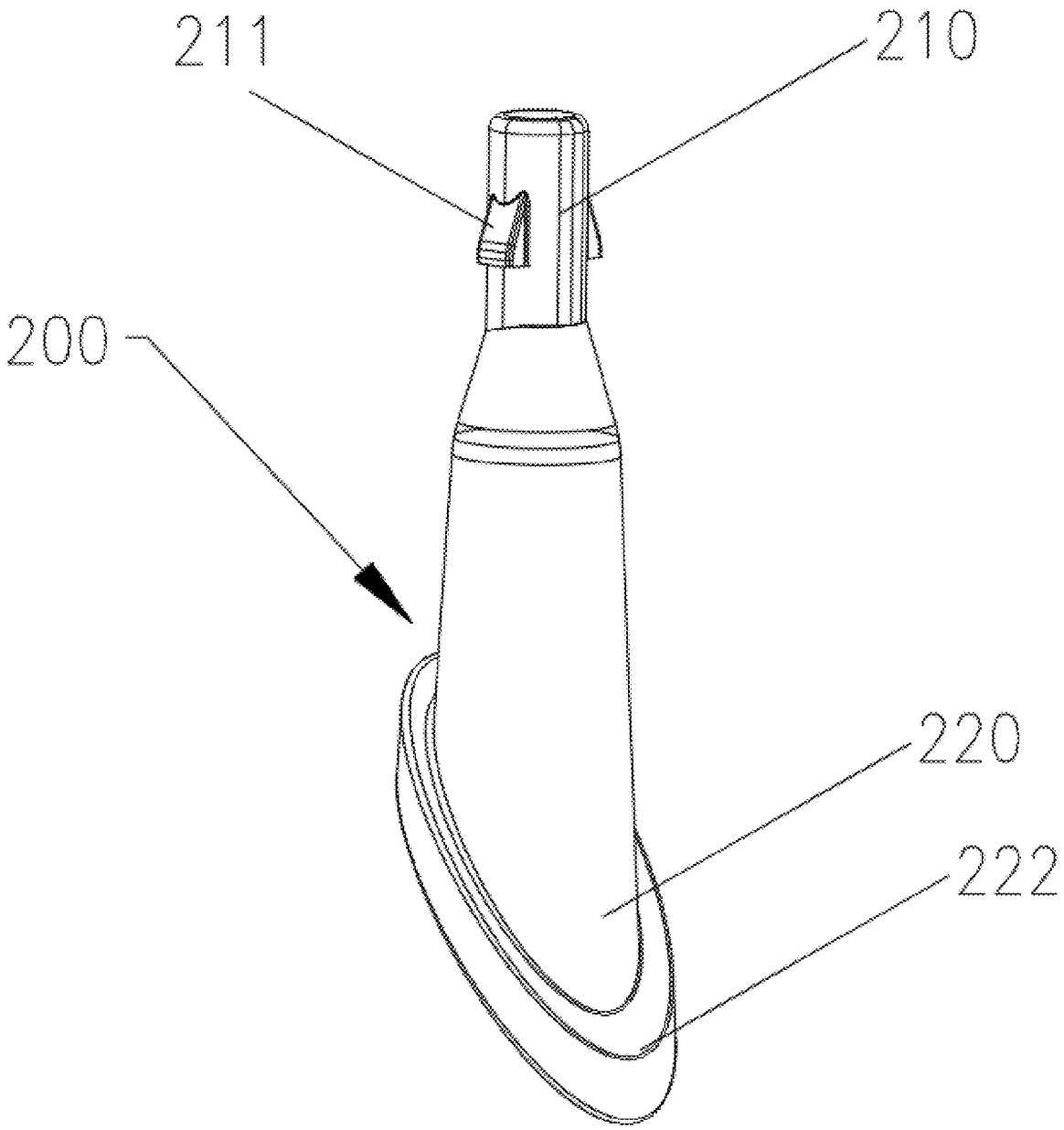
FIG. 8 is a second schematic structural view of a second application head according to Embodiment 1 of the present disclosure.

In another possible implementation, as shown in FIGS. 7-8, a thickness of the first end of the fastener 211 is less than a thickness of the second end of the fastener 211. Upon completion of assembly, as shown in FIG. 3, the second end of the fastener 211 abuts against a lower end surface of the clamping groove 111. In this way, the second application head 200 is assembled in the first application head 100 smoothly.

As shown in FIG. 7 and FIG. 8, the second application portion 220 includes a first end fixedly connected to the second mounting portion 210, and a second end being a free end. Bump 222 is fixedly provided at the second end of the second application portion 220. As shown in FIG. 4 and FIG. 5, groove 123 is formed at the second end of the first application portion 120. The groove 123 communicates with the accommodation cavity 101. The bump 222 is provided in the groove 123. This can further improve the bonding strength between the first application head 100 and the second application head 200.

Figure 6:
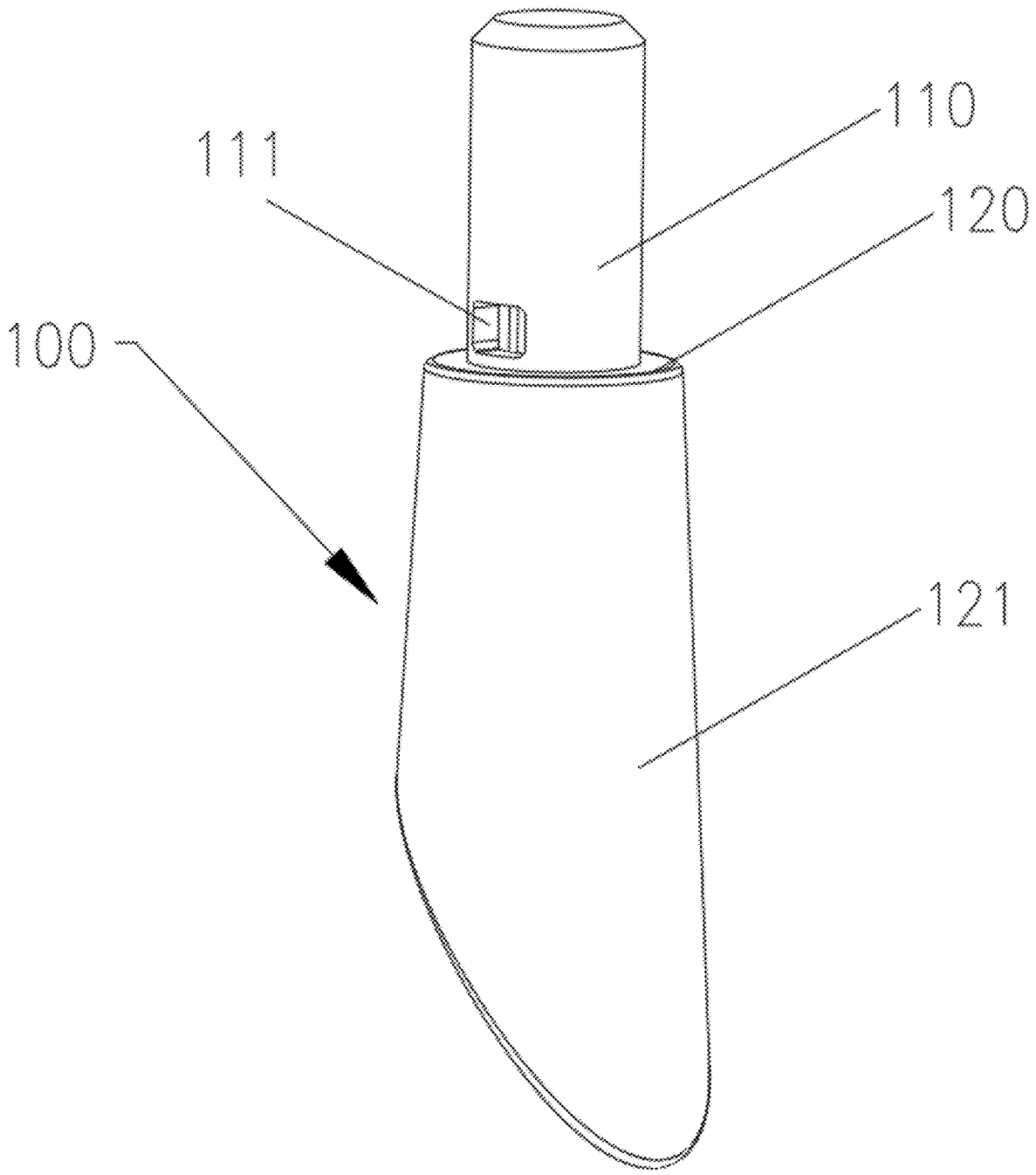
FIG. 6 is a second schematic structural view of a first application head according to Embodiment 1 of the present disclosure.

As shown in FIG. 5 and FIG. 6, an outer peripheral wall of the first application portion 120 forms first application surface 121. The first application portion 120 includes a cylindrical structure. Optionally, the first application portion 120 is a truncated cone-shaped structure. A size of the first end of the first application portion 120 is less than a size of the second end of the first application portion 120. The first application surface 121 is a cylindrical surface or a conical surface. As shown in FIG. 5, second application surface 124 is provided at the second end of the first application portion 120. That is, an oblique surface or a cambered surface formed by obliquely cutting the second end of the first application portion 120 is the second application surface 124.

As shown in FIG. 7 and FIG. 8, third application surface 221 is provided at the second end of the second application portion 220. In a possible implementation, the second application surface 124 and the third application surface 221 each are an oblique surface. The second application surface 124 and the third application surface 221 are coplanar. In another possible implementation, the second application surface 124 and the third application surface 221 each are a curved surface, and the second application surface 124 and the third application surface 221 are spliced into a smooth concave surface or a smooth convex surface.

As shown in FIGS. 1-4, in a possible implementation, a material of the first application head 100 includes a first plastic material. A material of the second application head 200 includes a second plastic material. A hardness of the first plastic material is less than a hardness of the second plastic material. Flocked layer 122 is provided on each of the first application surface 121, the second application surface 124 and the third application surface 221. The first application head 100 and the second application head 200 are machined by an injection molding process. After the second application head 200 and the first application head 100 are assembled into the applicator 400, the flocked layer 122 is formed by a flocking process on each of the first application surface 121, the second application surface 124 and the third application surface 221 of the applicator 400, so as to carry a cosmetic material or a skincare material. The material is applied through the first application surface 121, the second application surface 124 and the third application surface 221 to a makeup region, such as skin, and hair. With mutual cooperation among the cylindrical first application surface 121, the planar or cambered second application surface 124 and the planar or cambered third application surface 221, makeup requirements of the user on different regions and different effects are met, and the use functions of the applicator are expanded.

In another possible implementation, a material of the first application head 100 includes a plastic material. A material of the second application head 200 includes a temperature-sensitive material. The temperature-sensitive material includes metal, metal alloy, ceramic, glass or stone. The first application surface 121 and the second application surface 124 each are provided with flocked layer 122. The third application surface 221 is a smooth surface. When directly contacting skin, the third application surface 221 made of the temperature-sensitive material can provide a cold feeling. This expands pores, and facilitates shrinkage of the pores after the material is seeped into the pores, thus improving the absorption effect of the skin to the material, and achieving better material application uniformity. In another possible implementation, the first application surface 121, the second application surface 124 and the third application surface 221 each are provided with the flocked layer 122. The first application surface 121 and the third application surface 221 having different hardnesses and different shapes are used for makeup, which can realize different makeup effects, and can make the user achieve various feelings in use.

Figure 9:
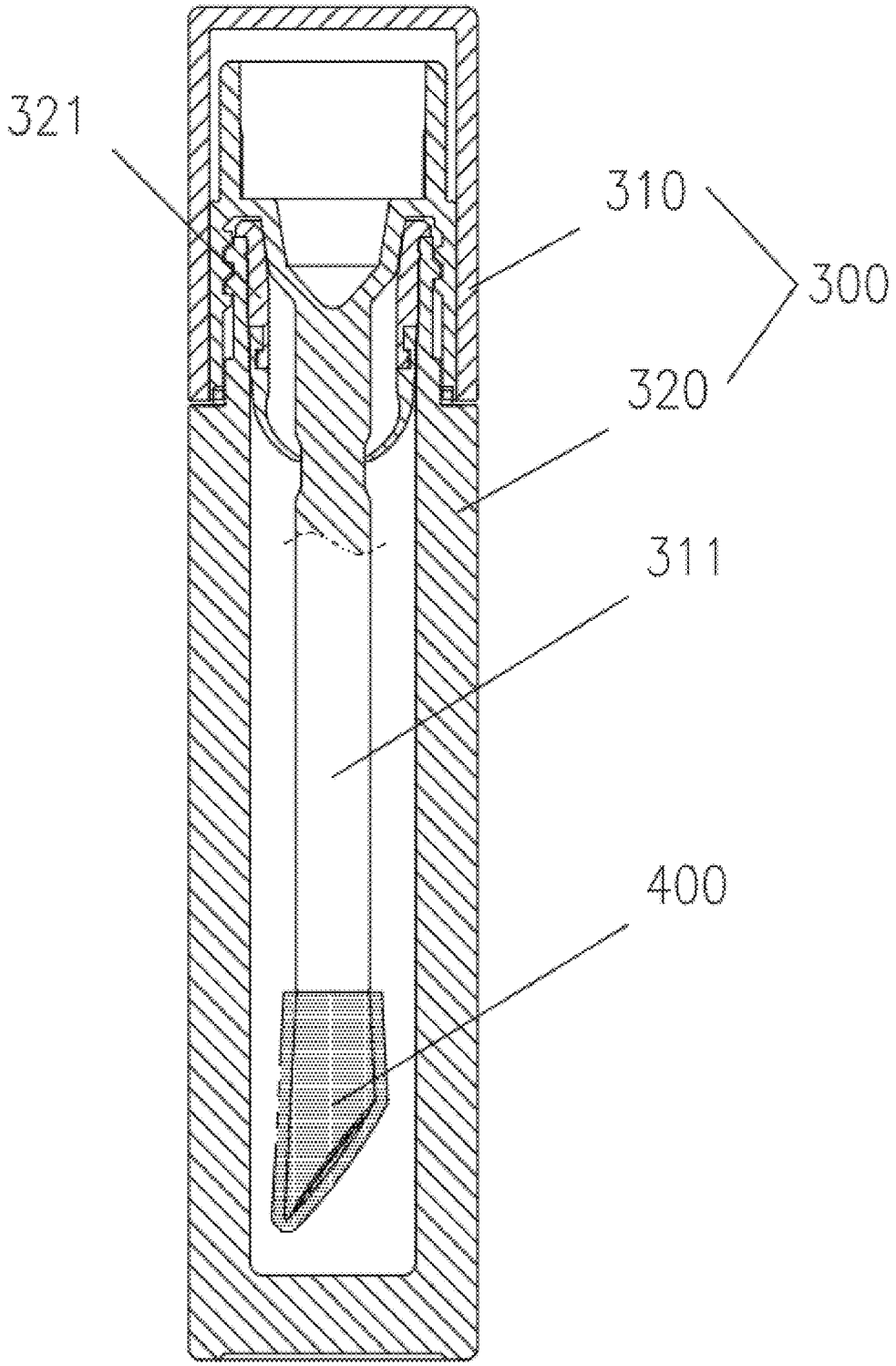
FIG. 9 is a schematic structural view of a packaging container according to Embodiment 2 of the present disclosure.

Embodiment 2: As shown in FIG. 9, a packaging container includes the split applicator and sleeve assembly 300. The sleeve assembly 300 includes outer lid 310 and bottle body 320. Brush rod 311 is fixedly provided in the outer lid 310. The outer lid 310 and the brush rod 311 are fixed by clamping of a clamping rib, gluing, and ultrasonic welding. The applicator 400 is fixedly provided on the brush rod 311. Inner stopper 321 is fixedly provided at a neck of the bottle body 320. The outer lid 310 covers the bottle body 320 detachably. The inner stopper 321 is configured to seal the brush rod 311 and the neck of the bottle body 320. An internal thread is provided on an inner sidewall of the brush rod 311. An external thread is provided on an outer sidewall of the bottle body 320. The brush rod 311 and the bottle body 320 are threadedly connected through the internal thread and the external thread. The bottle body 320 is configured to store the skincare material such as a facial cream, a hand cream and a body lotion, or the cosmetic material such as a mascara cream, a liquid mascara and eyebrow cream.

In the present disclosure, an operation process of the packaging container includes the following steps: The outer lid 310 is rotated, such that the outer lid 310 is separated from the bottle body 320. The outer lid 310 is pulled out. The inner stopper 321 scrapes an excessive material on the applicator 400. Then, the material is applied to the makeup region through the applicator 400. Upon completion of application, the applicator 400 is inserted into the bottle body 320. At last, the outer lid 310 is screwed to the bottle body 320 tightly.

It should be noted that a person of ordinary skill in the art can further make variations and improvements without departing from the conception of the present disclosure. These variations and improvements all fall within the protection scope of the present disclosure. Therefore, the protection scope of the present disclosure shall be subject to the appended claims.

What is claimed is:

1. A split applicator, comprising a first application head and a second application head, wherein an accommodation cavity is formed in the first application head; the first application head comprises a first mounting portion and a first application portion that are fixedly connected;

the second application head comprises a second mounting portion and a second application portion that are fixedly connected; the second application head is provided in the accommodation cavity;

the first mounting portion is fixedly connected to the second mounting portion;

the first application head is made of an elastic material; and a hardness of the first application head is less than a hardness of the second application head; and wherein a clamping groove is formed in the first mounting portion; the clamping groove communicates with the accommodation cavity; a fastener is provided on the second mounting portion; and the fastener is clamped into the clamping groove, wherein the first mounting portion and the second mounting portion are clamped and fixed; and wherein the second application portion comprises a first end fixedly connected to the second mounting portion, and a second end being a free end; a bump is fixedly provided at the second end of the second application portion; a groove is formed at a second end of the first application portion; the groove communicates with the accommodation cavity; and the bump is provided in the groove.

2. The split applicator according to claim 1, wherein a first end of the first mounting portion is connected to a first end of the first application portion; a second end of the first mounting portion and a second end of the first application portion each are a free end; and the accommodation cavity extends from the second end of the first application portion to the first mounting portion along an axial direction of the first application head.

3. The split applicator according to claim 2, wherein an outer peripheral wall of the first application portion forms a first application surface; a second application surface is provided at the second end of the first application portion; a third application surface is provided at a second end of the second application portion; and the second application surface and the third application surface each are an oblique surface, and the second application surface and the third application surface are coplanar; or the second application surface and the third application surface each are a curved surface, and the second application surface and the third application surface are spliced into a smooth concave surface or a smooth convex surface.

4. The split applicator according to claim 2, wherein the accommodation cavity is a blind groove or a through groove.

5. The split applicator according to claim 4, wherein an outer peripheral wall of the first application portion forms a first application surface; a second application surface is provided at the second end of the first application portion; a third application surface is provided at a second end of the second application portion; and the second application surface and the third application surface each are an oblique surface, and the second application surface and the third application surface are coplanar; or the second application surface and the third application surface each are a curved surface, and the second application surface and the third application surface are spliced into a smooth concave surface or a smooth convex surface.

6. The split applicator according to claim 1, wherein the clamping groove is a through groove or a blind groove; the fastener is elastic; and the fastener protrudes outward along a radial direction of the second mounting portion.

7. The split applicator according to claim 6, wherein an outer peripheral wall of the first application portion forms a first application surface; a second application surface is provided at a second end of the first application portion; a third application surface is provided at a second end of the second application portion; and the second application surface and the third application surface each are an oblique surface, and the second application surface and the third application surface are coplanar; or the second application surface and the third application surface each are a curved surface, and the second application surface and the third application surface are spliced into a smooth concave surface or a smooth convex surface.

8. The split applicator according to claim 1, wherein an outer peripheral wall of the first application portion forms a first application surface; a second application surface is provided at a second end of the first application portion; a third application surface is provided at a second end of the second application portion; and the second application surface and the third application surface each are an oblique surface, and the second application surface and the third application surface are coplanar; or the second application surface and the third application surface each are a curved surface, and the second application surface and the third application surface are spliced into a smooth concave surface or a smooth convex surface.

9. The split applicator according to claim 8, wherein a material of the first application head comprises a first plastic material; a material of the second application head comprises a second plastic material; a hardness of the first plastic material is less than a hardness of the second plastic material; and a flocked layer is provided on each of the first application surface, the second application surface and the third application surface.

10. The split applicator according to claim 8, wherein a material of the first application head comprises a plastic material; a material of the second application head comprises a temperature-sensitive material; the temperature-sensitive material comprises metal, metal alloy, ceramic, glass or stone; and the first application surface and the second application surface each are provided with a flocked layer, and the third application surface is a smooth surface; or the first application surface, the second application surface and the third application surface each are provided with the flocked layer.

11. A packaging container, comprising the split applicator according to claim 1, and further comprising a sleeve assembly, wherein the sleeve assembly comprises an outer lid and a bottle body; a brush rod is fixedly provided in the outer lid; the split applicator is fixedly provided on the brush rod; an inner stopper is fixedly provided at a neck of the bottle body; and the outer lid covers the bottle body detachably.

12. The packaging container according to claim 11, wherein in the split applicator, a first end of the first mounting portion is connected to a first end of the first application portion; a second end of the first mounting portion and a second end of the first application portion each are a free end; and the accommodation cavity extends from the second end of the first application portion to the first mounting portion along an axial direction of the first application head.

13. The packaging container according to claim 12, wherein in the split applicator, the accommodation cavity is a blind groove or a through groove.

* * * * *